US008671842B2

(12) United States Patent
Fresnel et al.

(10) Patent No.: US 8,671,842 B2
(45) Date of Patent: Mar. 18, 2014

(54) GAS GENERATOR AND MANUFACTURING METHOD THEREOF

(75) Inventors: Harold Fresnel, Ergue Gaberic (FR); Catherine Le Barh, Quimper (FR)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 13/574,961

(22) PCT Filed: Feb. 1, 2011

(86) PCT No.: PCT/EP2011/051344

§ 371 (c)(1), (2), (4) Date: Jul. 24, 2012

(87) PCT Pub. No.: WO2011/092336

PCT Pub. Date: Aug. 4, 2011

(65) Prior Publication Data

US 2012/0291656 A1 Nov. 22, 2012

(30) Foreign Application Priority Data

Feb. 1, 2010 (FR) ..... 10 50675

(51) Int. Cl.
*B60R 21/264* (2006.01)

(52) U.S. Cl.
USPC ..... 102/530; 102/531; 280/736; 280/741

(58) Field of Classification Search
USPC ..... 102/530, 531; 280/736, 741, 742
See application file for complete search history.

(56) References Cited

U.S. PATENT DOCUMENTS

| | | | | | |
|---|---|---|---|---|---|
| 3,897,962 | A | * | 8/1975 | Sack | 280/736 |
| 3,958,949 | A | | 5/1976 | Plantif et al. | |
| 5,259,643 | A | | 11/1993 | Kraft et al. | |
| 5,533,751 | A | * | 7/1996 | Kort et al. | 280/737 |
| 5,564,743 | A | * | 10/1996 | Marchant | 280/741 |
| 5,673,933 | A | | 10/1997 | Miller et al. | |
| 5,683,107 | A | * | 11/1997 | Headley et al. | 280/741 |
| 5,700,030 | A | * | 12/1997 | Goetz | 280/736 |

(Continued)

FOREIGN PATENT DOCUMENTS

| | | | |
|---|---|---|---|
| EP | 0496267 | A1 | 7/1992 |
| EP | 0776798 | A2 | 6/1997 |
| FR | 2922006 | A1 | 4/2009 |
| WO | 2009/043690 | A1 | 4/2009 |

OTHER PUBLICATIONS

International Search Report and Written Opinion of the ISA, ISA/EP, Rijswijk, NL, mailed May 9, 2011.

*Primary Examiner* — Bret Hayes
*Assistant Examiner* — Derrick Morgan
(74) *Attorney, Agent, or Firm* — Harness, Dickey & Pierce, P.L.C.

(57) ABSTRACT

A gas generator includes an outer wall delimiting a first chamber, a source of gas and a second chamber for diffusing gas outwards between which is found a nozzle. The nozzle includes a first through-hole for letting through gas from the first chamber to the second chamber. The first hole is closed by a cap capable of being opened from the triggering of an electro-pyrotechnic device located towards the first chamber. The second diffusion chamber includes in the wall at least one second through-hole for letting through gas outwards. The outer wall includes at least one overmolded plastic material around a portion of the metal nozzle.

8 Claims, 6 Drawing Sheets

(56) References Cited

U.S. PATENT DOCUMENTS

| | | | | | |
|---|---|---|---|---|---|
| 5,794,973 | A * | 8/1998 | O'Loughlin et al. | 280/737 |
| 5,887,893 | A * | 3/1999 | Lang et al. | 280/741 |
| 5,964,479 | A * | 10/1999 | Rink et al. | 280/741 |
| 6,068,289 | A * | 5/2000 | Bosio | 280/736 |
| 6,073,963 | A * | 6/2000 | Hamilton et al. | 280/741 |
| 6,158,769 | A * | 12/2000 | Swann et al. | 280/736 |
| 6,164,695 | A * | 12/2000 | Stevens et al. | 280/737 |
| 6,196,583 | B1 * | 3/2001 | Ruckdeschel et al. | 280/736 |
| 6,231,075 | B1 * | 5/2001 | Otsu | 280/735 |
| 6,231,078 | B1 * | 5/2001 | Kokeguchi | 280/736 |
| 6,244,623 | B1 * | 6/2001 | Moore et al. | 280/737 |
| 6,490,978 | B1 * | 12/2002 | Perotto et al. | 102/531 |
| 6,547,277 | B1 * | 4/2003 | Adamini et al. | 280/741 |
| 6,718,884 | B1 * | 4/2004 | Yabuta et al. | 102/530 |
| 6,739,362 | B2 * | 5/2004 | Lell | 141/313 |
| 6,752,421 | B2 * | 6/2004 | Khandhadia et al. | 280/741 |
| 6,871,873 | B2 * | 3/2005 | Quioc et al. | 280/741 |
| 7,111,558 | B2 * | 9/2006 | Brede et al. | 102/202.9 |
| 7,185,588 | B2 * | 3/2007 | Clark et al. | 102/530 |
| 7,584,992 | B2 * | 9/2009 | Riedel et al. | 280/736 |
| 8,172,262 | B2 * | 5/2012 | Mayville et al. | 280/741 |
| 2002/0007755 | A1 * | 1/2002 | Perotto et al. | 102/530 |
| 2002/0020320 | A1 * | 2/2002 | Lebaudy et al. | 102/202.9 |
| 2002/0189487 | A1 * | 12/2002 | Kubo et al. | 102/530 |
| 2003/0025313 | A1 * | 2/2003 | Sawa et al. | 280/741 |
| 2003/0034641 | A1 * | 2/2003 | Zimbrich et al. | 280/741 |
| 2003/0111832 | A1 * | 6/2003 | Kelley et al. | 280/736 |
| 2006/0202457 | A1 * | 9/2006 | Patterson | 280/740 |
| 2009/0102171 | A1 * | 4/2009 | Hordos | 280/741 |
| 2009/0230664 | A1 * | 9/2009 | Hayakawa et al. | 280/741 |
| 2010/0001497 | A1 * | 1/2010 | Yamazaki et al. | 280/736 |
| 2010/0007123 | A1 * | 1/2010 | Cord et al. | 280/741 |
| 2010/0201111 | A1 * | 8/2010 | Yamazaki et al. | 280/741 |
| 2011/0031727 | A1 * | 2/2011 | McCormick | 280/742 |
| 2012/0031294 | A1 * | 2/2012 | Aoyagi et al. | 102/530 |
| 2012/0079958 | A1 * | 4/2012 | Nakayasu | 102/530 |
| 2013/0087065 | A1 * | 4/2013 | Biebl et al. | 102/530 |

* cited by examiner

GAS GENERATOR AND MANUFACTURING METHOD THEREOF

CROSS-REFERENCE TO RELATED APPLICATIONS

This application is a 371 U.S. National Stage of International Application No. PCT/EP2011/051344, filed Feb. 1, 2011, and published in English as WO 2011/092336 A1 on Aug. 4, 2011, which claims priority to French Patent Application No. FR 1050675, filed Feb. 1, 2010. The disclosures of the above applications are incorporated herein by reference.

FIELD

The invention relates to a gas generator.

A field of application of the invention is automotive safety.

BACKGROUND

The gas generator is for example used for inflating a safety bag (an airbag) in a motor vehicle in order to protect a person.

The type of gas generator concerned by the invention includes an outer wall delimiting at least partly at least one first chamber source of at least one gas and at least one second chamber for diffusing the gas outwards between which is found at least one nozzle including at least one first through-hole for letting the gas pass from the first chamber to the second chamber, the first hole of the nozzle being closed by at least one cap capable of being opened from the triggering of an electro-pyrotechnic device located towards the first chamber, the second diffusion chamber including in the wall at least one second hole for letting the gas pass outwards.

Presently, on the market, gas generators are found, the structure of which in majority consists of steel.

The majority steel proportion leads to a significant mass of the gas generators.

The fact that the outer wall is in metal has advantages for resistance to the internal pressure of the first chamber as well as during the letting through of the gas from the first chamber to the second diffusion chamber through the nozzle.

Indeed, this passage of gas in the nozzle should be accomplished in a very short time, of the order of a few tens of milliseconds or less for meeting the rapidity requirements for inflating an airbag in the field of automotive safety.

Thus, the first hole is subject to high gas flow velocities (Mach number greater than 1) as well as to very high temperatures during the operating time (about 3,000 K for 50 milliseconds).

SUMMARY

The invention aims at obtaining a gas generator of the type described above and allowing a gain in weight and properly withstanding the internal pressure of the gas upon its triggering.

For this purpose, a first object of the invention is a gas generator, including an outer wall delimiting at least partly at least one first chamber, source of at least one gas, and at least one second chamber for diffusing the gas outwards between which is found at least one nozzle including at least one first hole for letting the gas pass from the first chamber to the second chamber, the first hole of the nozzle being a through-hole that is closed by at least one cap capable of being opened from the triggering of an electropyrotechnic device located towards the first chamber, the second diffusion chamber including in the wall at least one second hole for letting the gas pass outwards, characterized in that the outer wall includes at least one plastic material overmoulded around one portion of the metal nozzle.

According to an embodiment of the invention, the nozzle includes at least one third hole filled with the plastic material from the injection of the outer wall. The at least one third hole may be a through-hole.

According to an embodiment of the invention, the nozzle includes an outer edge joining two first and second opposite faces of the nozzle respectively located on the side of the first and second chambers, the overmoulded plastic material of the outer wall being applied against the outer edge and at least partly on the first and second opposite faces of the nozzle from the outer edge, the plastic material of the outer wall being overmoulded around the outer edge of the nozzle.

According to an embodiment of the invention, the nozzle includes at least one third hole filled with the overmoulded plastic material of the wall, said portion of the nozzle including its portion located between the outer edge, the first and second faces and said at least one third hole. The at least one third hole may be a through-hole.

According to an embodiment of the invention, the plastic material of the outer wall is at a distance from the inner edge of the first through-hole for letting through gas from the nozzle.

According to an embodiment of the invention, the nozzle includes an outer edge joining two first and second opposite faces of the nozzle respectively located on the side of the first and second chambers, the overmoulded plastic material of the outer wall being applied against the outer edge and covering all the first and second opposite faces of the nozzle from the outer edge, the plastic material of the outer wall being overmoulded around the outer edge and stopping at the inner edge of the first through-hole for letting through gas from the nozzle.

According to an embodiment of the invention, the nozzle includes at least one third hole filled with the overmoulded plastic material of the outer wall, the plastic material of the outer wall forms a peripheral edge only covering the annular peripheral area of the nozzle in which is found the third hole. The at least one third hole may be a through-hole.

According to an embodiment of the invention, the nozzle includes an outer edge joining two first and second opposite faces of the nozzle respectively located on the side of the first and second chambers, the overmoulded plastic material of the outer wall being applied against the outer edge and at least partly onto the first and second opposite faces of the nozzle from the outer edge, the plastic material of the outer wall being overmoulded around the outer edge of the nozzle, the nozzle including on either or both of its faces at least one non-through recess filled with the overmoulded plastic material of the wall.

According to an embodiment of the invention, the cap is metal and adhesively bonded onto a metal face of the nozzle towards the first chamber.

According to an embodiment of the invention, the cap is formed by the plastic material of the overmoulded wall on the side of the first chamber and obturating the first through-hole.

A second object of the invention is a method for manufacturing a gas generator as described above, characterized in that at least one plastic material is injected into a mould around said portion of the metal nozzle in order to form the outer wall overmoulded on the nozzle and attached to the latter, the outer wall including at least one second hole towards the outside at one side of the nozzle which at least partly delimits a diffusion chamber for diffusing gas outwards.

BRIEF DESCRIPTION OF THE DRAWINGS

The invention will be better understood upon reading the description which follows, only given as a non-limiting example with reference to the appended drawings, wherein.

DETAILED DESCRIPTION

Figure 1:
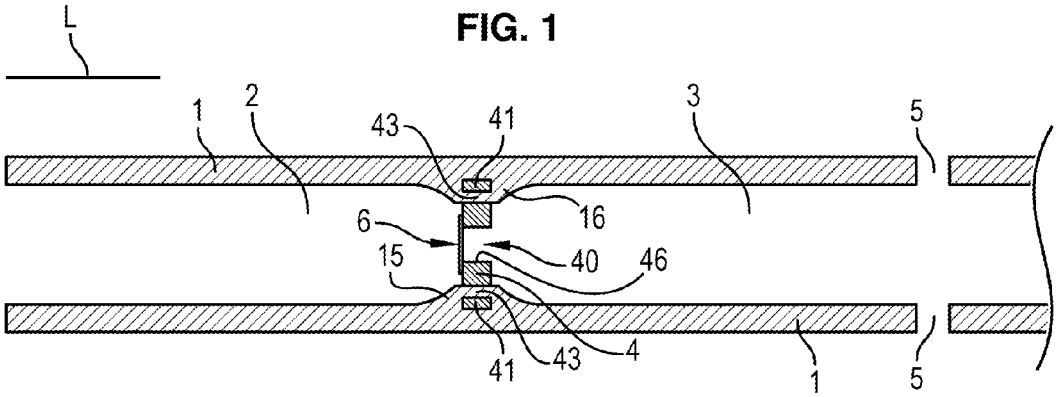
FIG. 1 schematically illustrates as a longitudinal sectional view a first embodiment of the outer wall and of the nozzle according to the invention, FIG. 2 schematically illustrates as a longitudinal sectional view in an enlargement, the nozzle in the first embodiment according to the invention, FIG. 3 schematically illustrates a front view, i.e. a transverse view, of the nozzle in the first embodiment of FIGS. 1 and 2, FIG. 4 schematically illustrates as a longitudinal sectional view a second embodiment of the outer wall and of the nozzle according to the invention, FIG. 5 schematically illustrates as a longitudinal sectional view a third embodiment of the outer wall and of the nozzle according to the invention, FIG. 6 schematically illustrates as a transversal sectional view the diffusion holes according to FIG. 5, FIG. 7 schematically illustrates as a front view from one side, the assembly illustrated in FIG. 5, FIG. 8 schematically illustrates an exemplary gas generator mounted in the assembly according to FIG. 5, FIG. 9 schematically illustrates as a longitudinal sectional view a fourth embodiment of the outer wall and of the nozzle according to the invention, FIG. 10 schematically illustrates as a longitudinal sectional view a fifth embodiment of the outer wall and of the nozzle according to the invention.

In FIG. 1, the outer wall of the gas generator bears reference 1 and for example is of an oblong shape along a longitudinal direction L, while being cylindrical, for example cylindrical with circular outer and inner sections. The wall 1 forms the main structure of the generator.

According to the invention, the outer wall 1 is at least partly in a plastic material, which may for example be polyamide but may also be selected from polyolefins, phenylene polysulphides (PPS), polyoxymethylenes (POM), or any other plastic material which may be injected or moulded by compression.

The wall 1 is for example entirely in plastic material.

Figure 6:
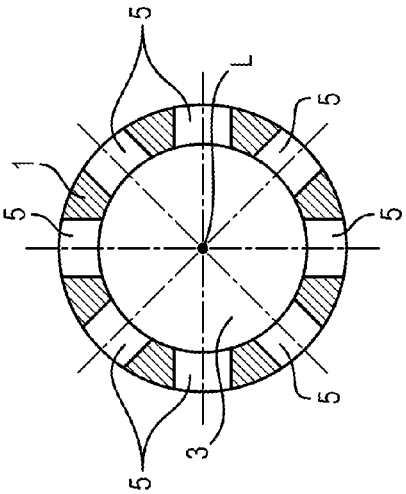

The outer wall 1 delimits at least partly a first chamber 2 source of a gas and a second chamber 3 for diffusion outwards of a gas which has to be contained in the chamber 2. The chamber 2 is separated from chamber 3 through a nozzle 4 including one or more holes 40 for letting through gas between the chambers 2 and 3, and for example a single central hole 40 for letting through gas, in the figures. The nozzle 4 is metal and is in steel for example. In the chamber 3, the wall 1 includes one or more second holes 5 for letting through gas from the second chamber 3 to the outside of the generator. These diffusion holes 5 cross the wall 1 and are for example distributed around the longitudinal direction L, for example regularly in one or more rows such as for example the two rows of eight holes 5 in FIG. 6.

Figure 3:
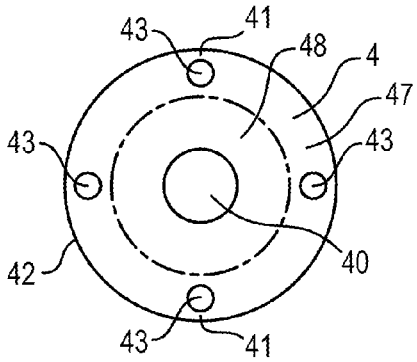

The hole 40 of the nozzle 4 is closed at least by a cap 6 capable of being opened when an electro-pyrotechnic device 7 located towards the first chamber 2 is triggered, this cap 6 not being illustrated in FIG. 3.

According to the invention, the outer wall 1 includes at least one overmoulded plastic material around or against a portion 41 of the nozzle 4, this nozzle 4 and its portion 41 being in metal.

It is therefore with only one manufacturing step that the nozzle 4 is attached in the outer wall 1, and this by overmoulding the plastic material of the outer wall 1 around the nozzle 4, the plastic material of the outer wall 1 surrounding, in the direction transverse to the longitudinal direction L, the outer edge 42 of the nozzle 4. With the invention, it is therefore possible to save on assembling operations. A gain is therefore achieved on cycle time during the method for manufacturing the generator. The pyrotechnic nozzle usually used is replaced by a insert 4 which is made by coining and forms the nozzle 4 which is overmoulded during injection of the plastic material of the outer wall 1.

Further, in the embodiments illustrated in the figures, the nozzle 4 includes in addition to the first hole 40, one or more additional holes 43 into which the plastic material of the outer wall 1 penetrates during moulding. The holes 43 may be through-holes. Therefore, in this case, the plastic material of the outer wall 1 also surrounds in the longitudinal direction L the portions 41 located between the outer edge 42 and the holes 43.

The plastic material of the outer wall 1 is overmoulded around the peripheral edge 42 of the nozzle 4 sealably around this peripheral edge 42 and against this peripheral edge 42.

In order to attach the nozzle 4 to the wall 1, the metal nozzle 4 is introduced into a mould, and the plastic material is then injected into the mould around the nozzle 4 in order to obtain the assembly 1, secured together as illustrated as an example in FIGS. 1, 4, 5, 7, 8, 9 and 10.

In the illustrated embodiments, the plastic material of the outer wall 1 is applied against a first transverse face 44 of the nozzle 4, which is located on the side of the first chamber 2 source of gas and against a second transverse face 45 of the nozzle 4, which is located on the side of the second diffusion chamber 3.

In the illustrated embodiments, the plastic material of the outer wall 1 also fills the hole(s) 43 from the first face 44 to the second face 45.

In the illustrated embodiments, the outer peripheral surface 42 of the nozzle 4 for example has a rectilinear longitudinal profile without any groove, said groove would be difficult to make at a low cost, this groove being known in order to be used for receiving the seal gasket. Because of the overmoulding of the outer wall 1 relatively to the nozzle 4, a seal gasket is omitted between the nozzle 4 and the wall 1, which provides an additional gain in lightness and in simplicity. Thus, there is no overcost related to the gasket, or any re-machining.

Thus, in gas generators of the known type as indicated at the beginning of the present statement, the metal outer wall required a nozzle with a mass of 17.7 grams having a longitudinal dimension of 3.75 mm for an outer diameter of 26.4 mm and a first central hole 40 for letting through gas with a diameter of 4 mm.

Figure 2:
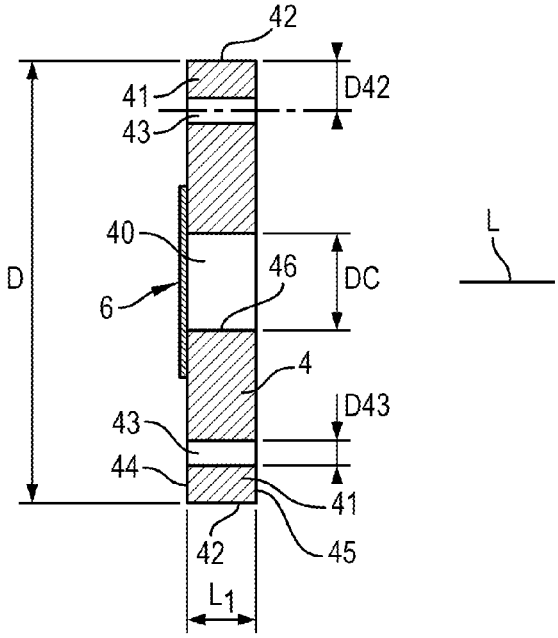

With the invention, it is possible to operate the gas generator with a nozzle 4, the longitudinal dimension L1 of which is less than or equal to 3 mm and the outer transverse dimension D of which may be substantially equivalent to known nozzles with dimensions DC equal to those of the central hole 40. In the exemplary embodiment illustrated in FIG. 2, where the dimensional scales have not been observed, the nozzle 4 for example has an outer dimension D of about 29 mm, a longitudinal dimension L1 of 2 mm for a dimension DC of the central hole 40 of 4 mm, a transverse distance D42 from the centre of the holes 43 relatively to the outer edge 42, equal to 3 mm and a transverse dimension D43 of the four holes 43 of about 2 mm, while being in steel for a mass of 8.8 grams, which provides a reduction in the mass of the nozzle 4 by more than 50% for the known nozzle example indicated above having a mass of 17.7 grams for the same steel.

Of course, the total mass of the assembly 1, 4 is still further reduced by the fact that the outer wall 1 is in plastic material.

The holes 43 are for example made by punching, which is more economical.

The overmoulding of the plastic material of the peripheral wall 1 is provided so as not to cover the orifice 40 for letting through gas, i.e. the inner edge 46 of the latter in the nozzle 4, in order to avoid erosion of the plastic material during the operation of the generator and therefore retain the integrity of the plastic material. The shape of the nozzle 4 is defined so as to be compatible with the injection method of the wall 1 and to guarantee because of its shape, the seal in the overmoulded portion. The shape of the nozzle 4 is simplified in order to be compatible with a method for manufacturing the nozzle 4 which is cheap, such as coining or forging and with reduced thickness.

For example, in the embodiment illustrated in FIG. 1, the plastic material of the outer wall 1 additionally leaves the area of the faces 44 and 45 exposed, located between the holes 43, so as to only form a peripheral edge 15 located on the side of the chamber 2 and a peripheral edge 16 located on the side of the chamber 3, these edges 15, 16 for example being annular around the longitudinal direction L by only covering the outer annular area 47 of the nozzle 4 in which are found the holes 43 and portions 41 in proximity to the outer edge 42, the limit between the outer annular area 47 and the inner annular area 47 of each face 44, 45 being represented by the fictitious circle in dashed lines in FIG. 3.

Figure 4:
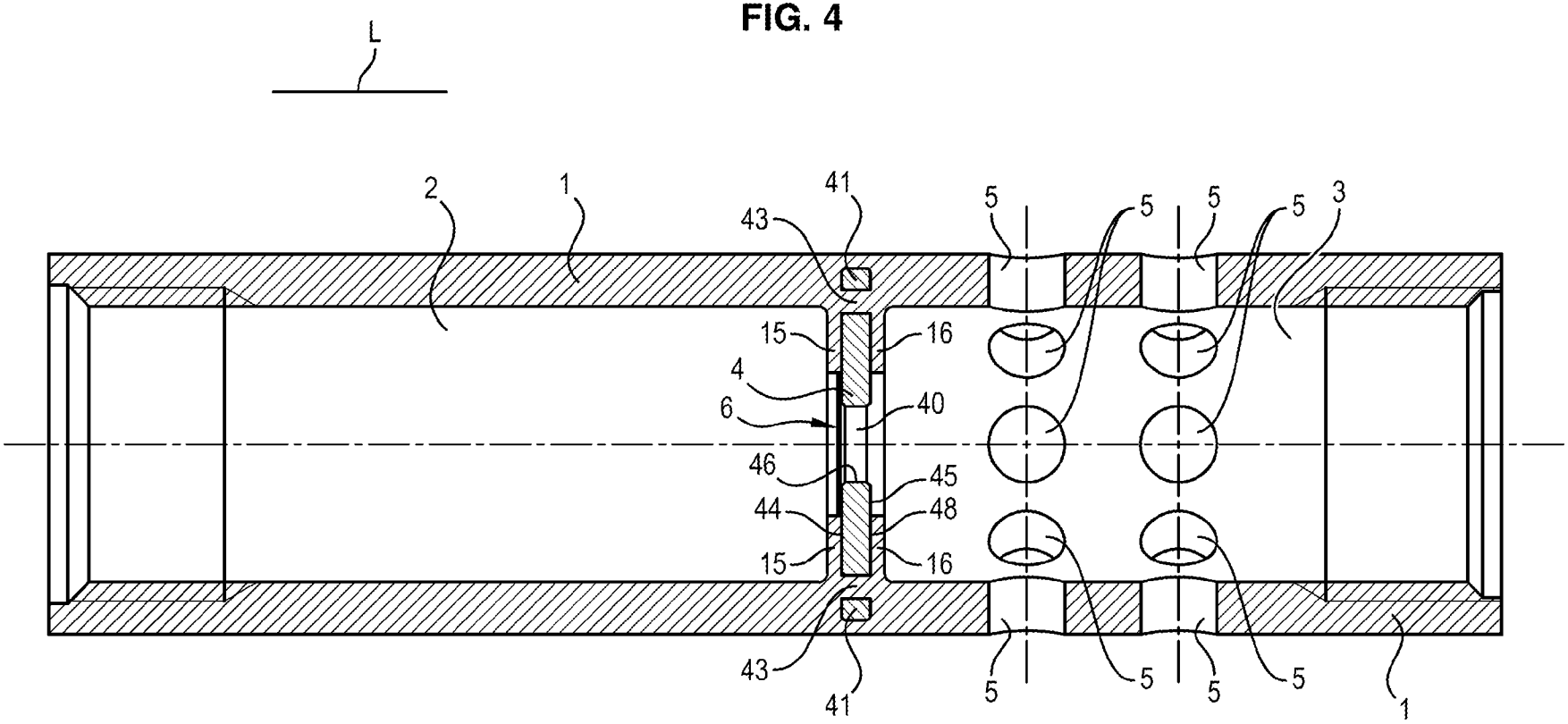
Figure 7:
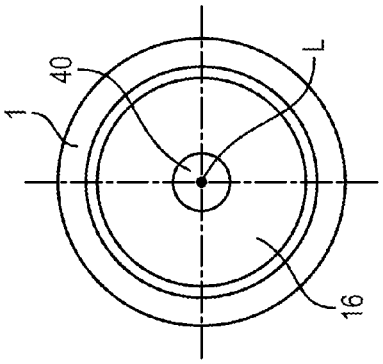
Figure 10:
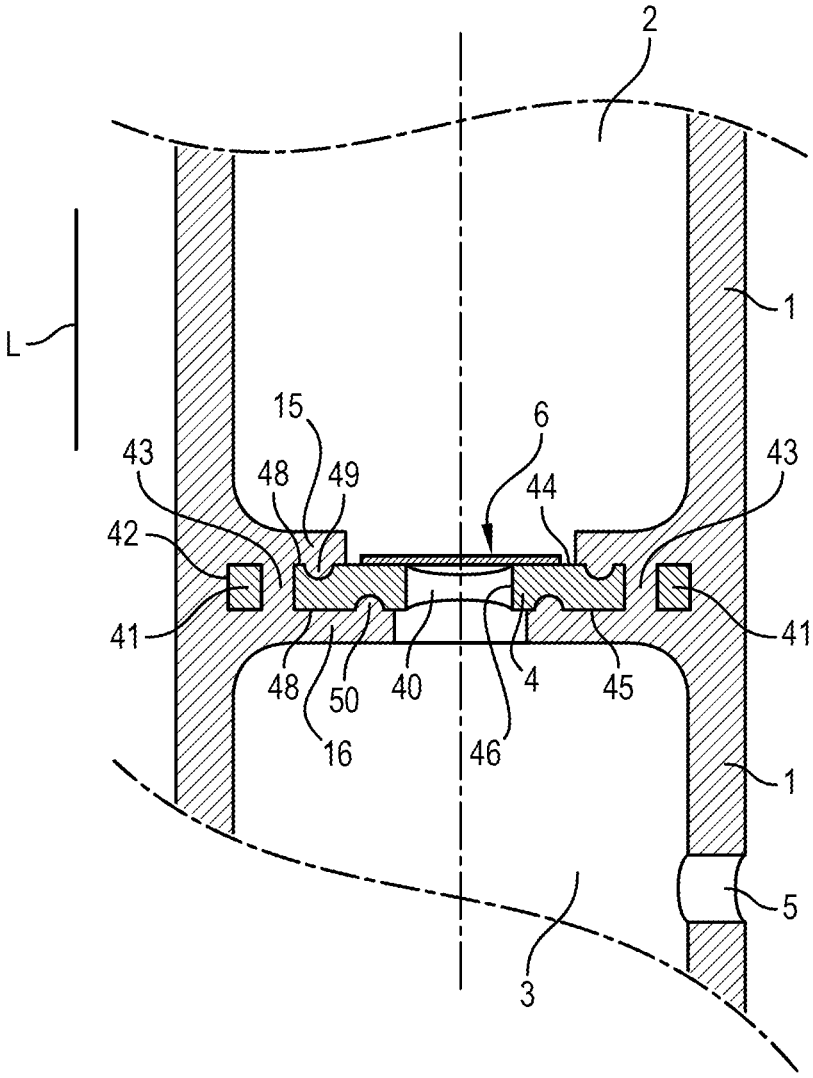

In the embodiment illustrated in FIGS. 4 and 10, the plastic material of the outer wall 1 comprises areas 15, 16 partly covering from the outside the inner annular portion 48 of the faces 44 and 45 located between the orifice 40 for letting through gas on the one hand and the holes 43 and portions 41 on the other hand.

Figure 5:
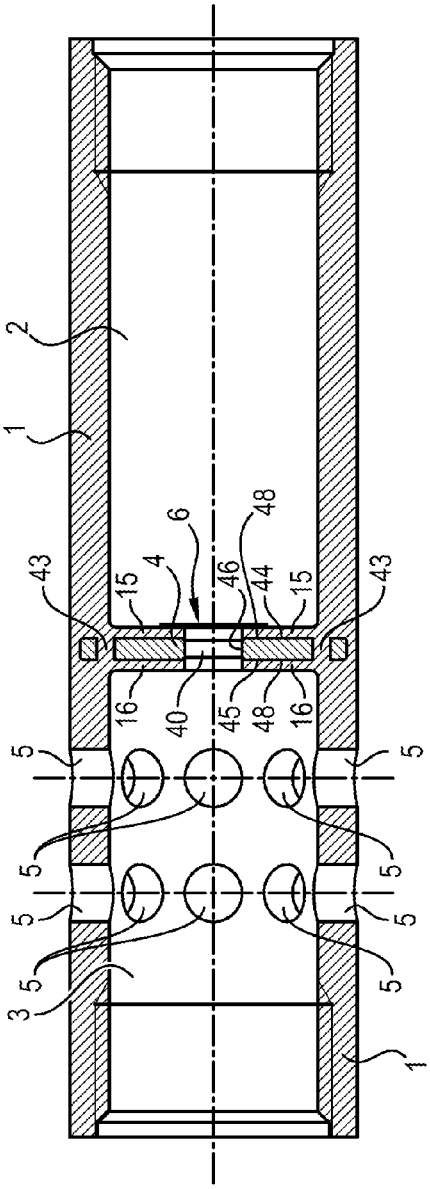
Figure 8:
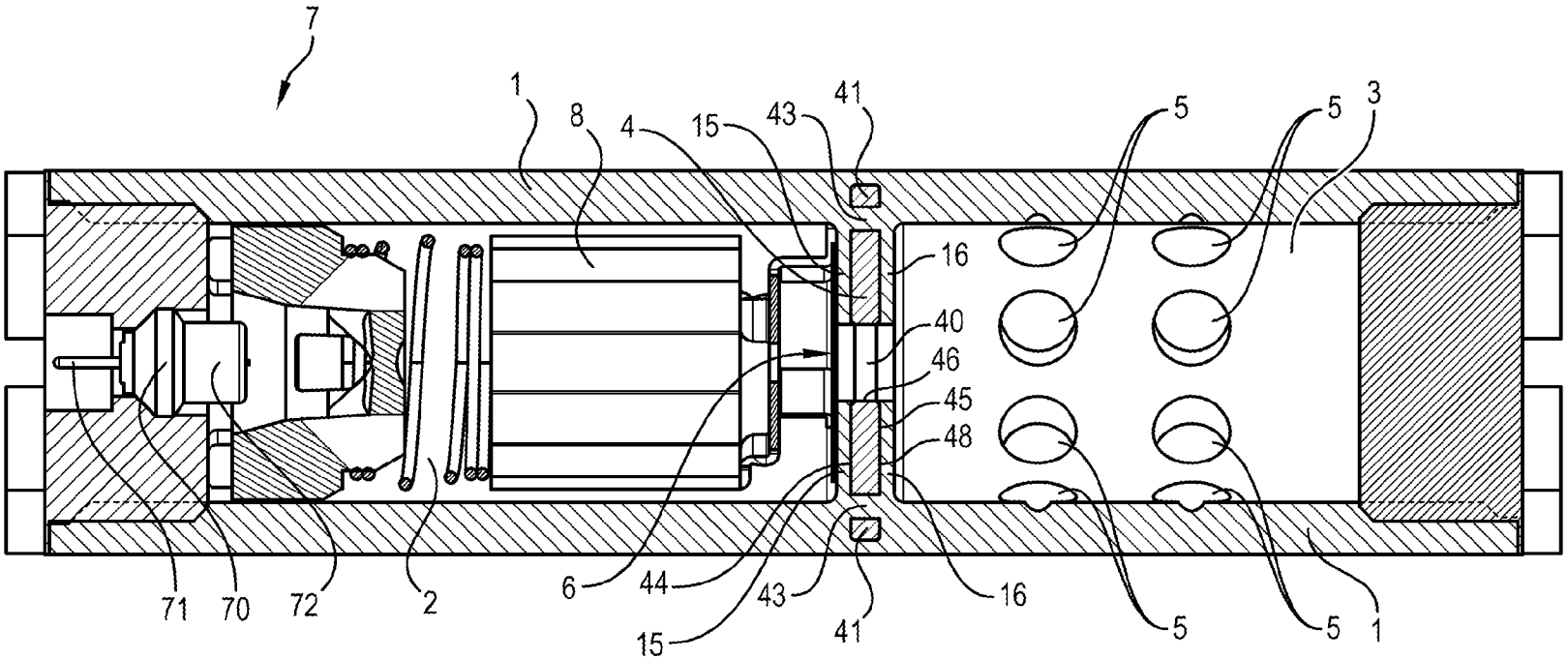

In the embodiment illustrated in FIGS. 5 and 8, the areas 15 and 16 of the overmoulded plastic material of the outer wall 1 run up to the inner edge without covering the latter, i.e. they cover the whole area 48 of the two faces 44 and 45.

In the embodiment illustrated in FIG. 10, the nozzle 4 includes on either or both of its faces 44, 45 at least one non-through recess 49 and/or 50, which is filled with the plastic material injected from the wall 1, the overmoulded plastic material of the wall 1 then surrounding the portion of the nozzle 4 located between the edge 42 and the recess 49 and/or 50. At least one recess 49 is for example provided on the face 44 and at least one other recess 50 is for example provided on the face 45. The recess 49 and/or 50 is for example formed by an annular groove. Both annular grooves 49, 50 are for example offset relatively to each other as illustrated in FIG. 10, but they may also be facing each other while being separated by the thinner portion of the nozzle 4. The seal is thereby still further improved. The recess 49 and/or 50 is for example located on the inner area 48 of the face 44 and/or 45.

The first chamber 2 comprises means for providing one or more pressurized gases. These means for providing one or more pressurized gases, as well as the electro-pyrotechnic device 7, are illustrated as an example in FIGS. 8 and 9 and may of course be provided in the embodiments of the other figures.

Figure 9:
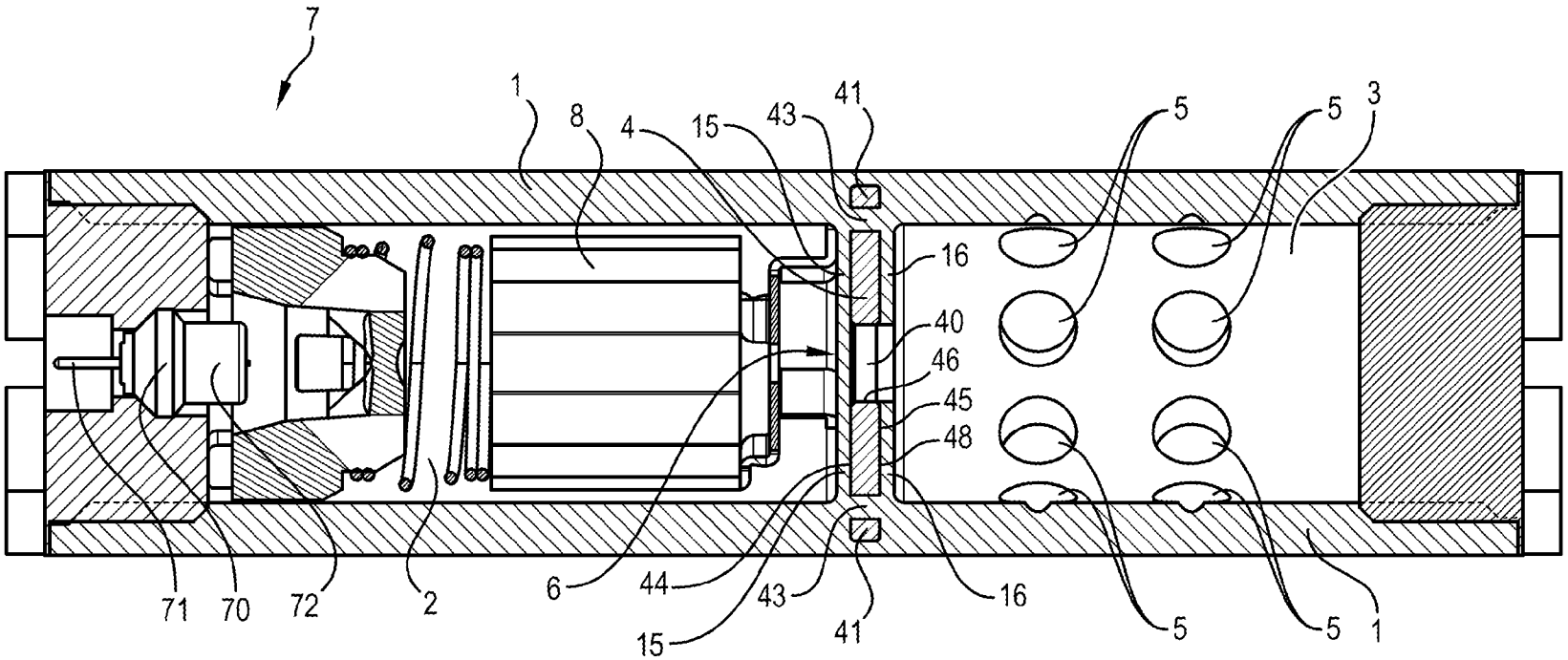

For example, in FIGS. 8 and 9, the first chamber 2 source of gas comprises a block 8 of propellant or of any other pyrotechnic material providing gas by combustion.

In a general way, the electro-pyrotechnic device 7 comprises one or more electro-pyrotechnic initiators 70 including at least two electric terminals accessible from the outside of the chamber 2 in order to send an electric signal for controlling the triggering of the gas generator. The initiator 70 includes an inner pyrotechnic charge which is then ignited by the electric signal present on the terminals 71, this electric signal being sent by an outer electric circuit intended to be connected to the gas generator, this outer electric circuit sending the electric signal for controlling the triggering for example when an impact is detected by an impact sensor on a motor vehicle.

In response to the electric control signal present on the terminals 71, the pyrotechnic charge contained in the cap 72 of the initiator 70 is ignited, which causes combustion of the propellant block 8, this combustion of the block 8 generates gas in the chamber 2. The rise in pressure of the gas evolved in the chamber 2 causes breaking of the cap 6 which closed the orifice 40 of the nozzle 4, the pressurized gas in the chamber 2 then passes through the passage orifice 40 of the nozzle 4 so as to pass into the second diffusion chamber 3 and from there to be discharged outwards through the orifice(s) 5. In this case, it is the combustion of the pyrotechnic charge contained in the cap 72 of the initiator 70 which causes the rise in pressure of the gas in the chamber 2 which, beyond a certain pressure threshold, breaks the cap 6 so as to have the first chamber 2 communicating with the second chamber 3 through the passage of the orifice 40.

The cap 6 initially closing the gas passage orifice 40 of the nozzle 4 for containing the gas generation means 8 in the first chamber 2, may be made by any means.

The cap 6 may for example be in metal, for example in copper.

The cap 6 may for example be in metal, for example in copper and be adhesively bonded onto the first metal face 44 of the nozzle 4 on the side of the first chamber 2 in order to close the first hole 40, as this is for example the case for FIGS. 1, 4 and 10.

The cap 6 may for example be in metal, for example in copper, and be attached, for example by being adhesively bonded, against the portion 15 in plastic material covering all or part of the face 44 of the nozzle 4 located on the side of the first chamber 2, as this is for example the case in FIGS. 5 and 8 and may also be the case in FIG. 4 and in FIG. 10.

In the embodiment illustrated in FIG. 9, the plastic material of the wall 1 overmoulded on the side of the first chamber 2, source of gas, is also used for forming the cap 6, i.e. the overmoulded plastic material area 15 extends over the whole of the face 44 located on the side of the first chamber 2 and over the whole area 48 while being interposed in front of the gas passage hole 40 and obturating it, by which it is possible to make in a single overmoulding operation, the outer wall 1, the nozzle 4 and the cap 6.

The invention claimed is:

1. A gas generator comprising:

an outer wall at least partly delimiting at least one first chamber;

a source of at least one gas;

at least one second chamber for diffusing the gas outwards, the at least one second chamber including in the outer wall at least one first hole for letting the gas pass outwards;

at least one nozzle including a second hole for letting the gas pass from the first chamber to the second chamber, the second hole of the nozzle being a through-hole that is closed by at least one cap capable of being opened from the triggering of an electropyrotechnic device located towards the first chamber, the nozzle including a plurality of third holes each arranged between the second hole and an outer periphery of the nozzle, and wherein the outer wall includes at least one plastic material overmoulded around the outer periphery of the nozzle and first and second opposite faces of the nozzle and completely filling the third holes.

2. The gas generator according to claim 1, wherein the third holes are through-holes.

3. The gas generator according to claim 1, wherein the plastic material of the outer wall is at a distance from the inner edge of the second hole for letting through gas from the nozzle.

4. The gas generator according to claim 1, wherein the overmoulded plastic material of the outer wall covers all the first and second opposite faces of the nozzle, the plastic material of the outer wall being overmoulded around the outer periphery and stopping at the inner edge of the second hole for letting through gas from the nozzle.

5. The gas generator according to claim 1, wherein the third holes are through recesses filled with the plastic material.

6. The gas generator according to claim 1, wherein the cap is metal and adhesively bonded onto a metal face of the nozzle towards the first chamber.

7. The gas generator according to claim 1, wherein the cap is formed by the plastic material of the overmoulded wall on the side of the first chamber and obturating the second hole.

8. A method for manufacturing the gas generator according to claim 1, the method comprising: injecting at least one plastic material into a mould around said portion of the metal nozzle in order to form the outer wall overmoulded on the nozzle and attached to the latter, wherein the first hole at least partly delimits a diffusion chamber for diffusing gas outwards.

* * * * *